US005379459A

United States Patent [19]

Williams, Jr.

[11] Patent Number: 5,379,459

[45] Date of Patent: Jan. 10, 1995

[54] BASEBALL GLOVE INCORPORATING ARAMID BRACES

[75] Inventor: Charlton H. Williams, Jr., Marietta, Ga.

[73] Assignee: Natraflex Systems, Inc., Columbus, Ga.

[21] Appl. No.: 14,445

[22] Filed: Feb. 5, 1993

[51] Int. Cl.[6] ..... A41D 13/08

[52] U.S. Cl. ..... 2/19; 2/161.1; 2/167

[58] Field of Search ..... 2/16, 19, 20, 159, 160, 2/161.1, 166, 167

[56] References Cited

U.S. PATENT DOCUMENTS

| | | | |
|---|---|---|---|
| 2,025,357 | 12/1935 | Pagan . | |
| 2,354,601 | 7/1944 | Latina | 2/19 |
| 3,171,652 | 3/1965 | Newman . | |
| 3,231,460 | 1/1966 | Andrews . | |
| 3,300,787 | 1/1967 | Denkert | 2/19 |
| 3,461,593 | 8/1969 | Martuch . | |
| 3,711,090 | 1/1973 | Fiedler . | |
| 3,886,024 | 5/1975 | Chase . | |
| 4,301,201 | 11/1981 | Stout . | |
| 4,361,324 | 11/1982 | Baroi . | |
| 4,428,763 | 1/1984 | Layden . | |
| 4,477,927 | 10/1984 | Tsubota et al. | 2/19 |
| 4,863,159 | 9/1989 | Brown, Jr. . | |
| 4,872,664 | 10/1989 | Parker . | |
| 4,914,966 | 4/1990 | Shlenker . | |
| 4,928,320 | 5/1990 | Aoki | 2/19 |
| 4,974,837 | 12/1990 | Someya . | |
| 5,019,096 | 5/1991 | Fox . | |
| 5,075,889 | 12/1991 | Funahashi | 2/19 |
| 5,113,849 | 5/1992 | Kuiken . | |
| 5,122,226 | 6/1992 | Minford . | |
| 5,253,365 | 10/1993 | Clevenhagen | 2/19 |

*Primary Examiner*—Peter Nerbun
*Assistant Examiner*—Larry D. Worrell, Jr.
*Attorney, Agent, or Firm*—Jones & Askew

[57] ABSTRACT

A baseball glove incorporating a continuous lacing system and a unique brace system. The brace system urges the glove into an open position when placed on the hand of a user and supports the form of the glove. The continuous lacing system allows a user to form his or her glove into a desired pocket configuration.

29 Claims, 4 Drawing Sheets

BASEBALL GLOVE INCORPORATING ARAMID BRACES

FIELD OF THE INVENTION

This invention relates in general to baseball gloves, and more specifically relates to a baseball glove incorporating braces to ease closing and opening of the glove and a continuous lacing system to control the pocket shape of the glove.

BACKGROUND OF THE INVENTION

Baseball gloves have been around since the advent of baseball over 100 years ago. Sand lots all over the country are filled with softball and baseball players, each garnishing their own glove. The baseball glove industry is a multi-million dollar industry which reaches all levels of our society. Despite this, baseball glove technology has basically remained the same for the last 100 years.

Conventional gloves are made of a sturdy leather material and use firm, solid padding to maintain their shape. The leather is generally two layers: an outer shell of a thick leather, and an inner layer of smooth leather for contacting the surfaces of the hand. Thick pads are used between these layers of leather to protect the hand of the user and to provide support for the glove. These pads often include a plastic insert running their length so as to make the pad stiffer and to give more support for the glove. The pads and the plastic often extend up the stalls which receive the fingers and thumb. Padding which is more flexible is used at the palmar section of the glove so that closing of the glove is possible. However, the thick padding often extends from the top of the thumb stall downward to the palm of the hand, making movement of the thumb difficult. In fact, the design of the gloves is such that movement is made by the finger stalls of the gloves only, such that the finger stalls move over and overlay the webbing and the thumb stall, creating an elongate wedge for closing the ball within.

The stiff leather and padding material used in conventional gloves are often difficult to maneuver and shape. In fact, many players have developed complex techniques to break in their gloves. One method involves the steps of oiling down the glove, placing a ball within the webbing, and wrapping a rope around the finger stalls, the thumb stall and the webbing so that a pocket can be formed. The glove is then left in that position for an extended period of time. Some players beat their gloves with hammers to loosen the material or to make it more pliable. After working the gloves to this degree, the top ends of the thumb and finger stalls loose their shape. Thus there is a need for a baseball glove which would not require an extended break-in period, yet can maintain its shape over the life of the glove.

The present padding and thick leather designs of conventional gloves also make them heavy for use, especially for younger or weaker players. The combination of the stiff, rigid material and the weight of the material makes the glove difficult to manipulate. For these reasons, a lighter weight glove is needed.

Once the stiff leather and padding is loosened up enough so that the glove is broken in, the glove has a tendency to lose its form and remain in a closed position. Thus, the user must hold the glove open by using physical force when catching the ball. This can be dangerous for a player with weaker hands or a younger player who cannot hold the glove open. A closed glove may cause the player to miss the ball or mis-catch the ball, perhaps causing the ball to strike the player. Therefore, there is a need for gloves to have a tendency to be opened so as to ease catching or fielding of the ball.

Because of the loss of shape of the glove after breaking in, the padding extending up the length of the thumb and finger stalls often loose their shape. Thus, a user with its hand in the glove often finds that the only region of the glove that moves when attempting to move the fingers is that part of the glove immediately adjacent to the hand. There is a need for a light support system in the gloves which could act as an extension of the fingers so that the fingers may have leverage to fully control the entire length of the finger or thumb stalls.

Closure of the glove by movement of the finger stalls over the thumb stall and webbing of conventional gloves requires use of the closure process of the medicarpal phalangeal "MP" joint. This closure is not advantageous because it does not use the stronger muscles connected to the thumb. Preferably, closure of the glove would be by the pinch mechanism of the hand, which is formed between the thumb and fingers. This allows use of the muscles associated with the thumb, as well as the muscles along the MP joint.

Although it is ideal for a glove to remain in the open position when on the hand of a user, some players, especially infield players, prefer that a circular or "U-shaped pocket" be formed by the glove, so as to better trap the ball upon catching or fielding. These pockets are formed by keeping the glove in an open position and forcing the upper ends of the thumb and finger stalls inward. Thus, when facing the glove from the direction a ball will travel towards the glove, the outer perimeter of the glove seems to have a circular or semicircular appearance with the thumb and little finger stalls having a concave shape such that the central portions of the stalls bow outward relative to the pocket of the glove and the lower and upper portions of the stalls bow inward. Presently, players form this type of pocket by working their glove into the bowed shape. This is done by biasing the glove into that position and holding it that way for the extended period of time. Since the padding and stiff leather material of the gloves does not have a memory for its beginning position, it will have a tendency to maintain that position once it is held in that manner for the extended period of time. However, although this position may be formed, retaining the shape of the pocket is difficult once the glove has been well broken in. Also, once the pocket has been formed, it is difficult to return the glove to its natural shape. There is a need for an easily-formable U-shaped pocket which may be released and returned to its natural shape if needed.

In summary, there is a need in the art for a lighter weight glove which is easier for a player to open and close. Preferably, the glove will maintain its shape over its life and will be comfortable for a player. In addition, the glove should be able to be formed into a desirable shape so that the player may catch and field balls with the least amount of effort.

SUMMARY OF THE INVENTION

The present invention solves the above-mentioned problems by providing a glove using a unique brace system and a continuous lacing system. The glove is flexible and comfortable, yet offers control and durability. The internal mechanical structure of the glove automatically opens the glove when a player puts it on. The player will be able to start using the glove immediately without the usual break-in period associated with conventional gloves. In addition, the continuous lacing system allows a player to form the perfect U-shaped pocket for more control and pliability. Finally, the brace structure system offers exercise to the pinch mechanism of the hand, which strengthens the players hand.

More specifically stated, the baseball glove includes a thumb stall defining a first lateral edge of the glove, the thumb stall having an upper end and a lower end. A finger stall is included which defines an opposing second lateral edge of the glove and has an upper end and lower end. The glove includes a heel portion interconnecting the lower end of the thumb stall and the lower end of the finger stall. A continuous lace extends along the path from approximately the lower end of the thumb stall up the length of the thumb stall to the upper periphery. The lace continues around the upper periphery to the upper end of the finger stall, and down the length of the finger stall to approximately the lower end of the finger stall. The lace is attached to the glove at a plurality of locations along this path. This path may further continue around the lower end of the thumb stall along the heel and the lower end of the finger stall. The lacing system may comprise a one-piece lace which extends around the perimeter and is tied to itself on the back side of the little finger stall. Alternatively, the lacing may comprise two laces, which are tied off at the ends of the little finger stall and the thumb stall. Preferably, the lacing system is stitched through the little finger stall and through the thumb stall.

Another embodiment of the present invention comprises a first flexible, resilient brace defining an initial shape and having a tendency to fully recover to its initial shape after bending, this tendency creating a resistance in said brace to bending. The brace extends along the thumb stall on the glove adjacent to the heel of the glove from a point, which when a user has the glove installed upon the user's hand, which is at least half way up the thumb of the user. The brace extends to a first location up the thumb stall such that the resistance of the brace to bending causes the thumb stall to be biased away from the little finger start, urging the glove into an open position. Urging the glove in this manner makes the glove more easily handled and controlled by players with weaker hands or younger players. The glove may include at least one additional brace having the same type of characteristics. This additional brace extends from a region in the glove which is adjacent to the joint of the thumb and the palm of the user when the user's hand is installed in the glove to a second location up the thumb stall. The resistance of this additional brace to bending gives support to the thumb stall and urges the second location on the thumb stall away from the little finger stall.

A third brace may be included having the same type of characteristics as the previously described braces and which extends along the length of one of the finger stalls. This brace would preferably extend from a region in the glove which is adjacent to the joint of the little finger and the palm of the user when the user's hand is installed in the glove up to a location in the little finger start. The resistance of this brace to bending gives support to the little finger stall and urges the location on the little finger stall away from the thumb stall.

A fourth rod may be included having the same type of characteristics as the previous rods and which extends along the back side of the thumb stall of the glove. The brace serves as an extension and leverage for the thumb of the user such that movement of the thumb stall of the glove is responsive to movement of the thumb of the user.

The braces of the present invention are preferably replaceable such that a new brace may be inserted once the useful life of the previous brace had expired.

Therefore, it is an object of the present invention to create an improved baseball glove.

It is a further object of the present invention to provide a baseball glove which offers flexibility and comfort as well as control and durability.

Another object of the present invention is to provide a baseball glove which is biased to the open position when placed on the hand of a user.

Still another object of the present invention is to provide a continuous lacing system.

Yet another object of the present invention is to provide a baseball glove which is lighter in weight than conventional baseball gloves.

Another object of the present invention is to provide a baseball glove which is easier to open and close than conventional gloves.

A further object of the present invention is to create a baseball glove which is closed by the pinch mechanism of the hand.

Still another object of the present invention is to provide a glove which does not require the ordinary break-in period of conventional gloves.

Yet another object of the present invention is to provide a baseball glove which retains its shape even after long periods of use.

Another object of the present invention is to provide a baseball glove which has a system of forming a pocket of the desired shape.

Further objects, features and advantages will become apparent upon consideration of the following detailed description of the invention when taken in conjunction with the drawing and the appended claims.

DESCRIPTION OF PREFERRED EMBODIMENT

Figure 1:
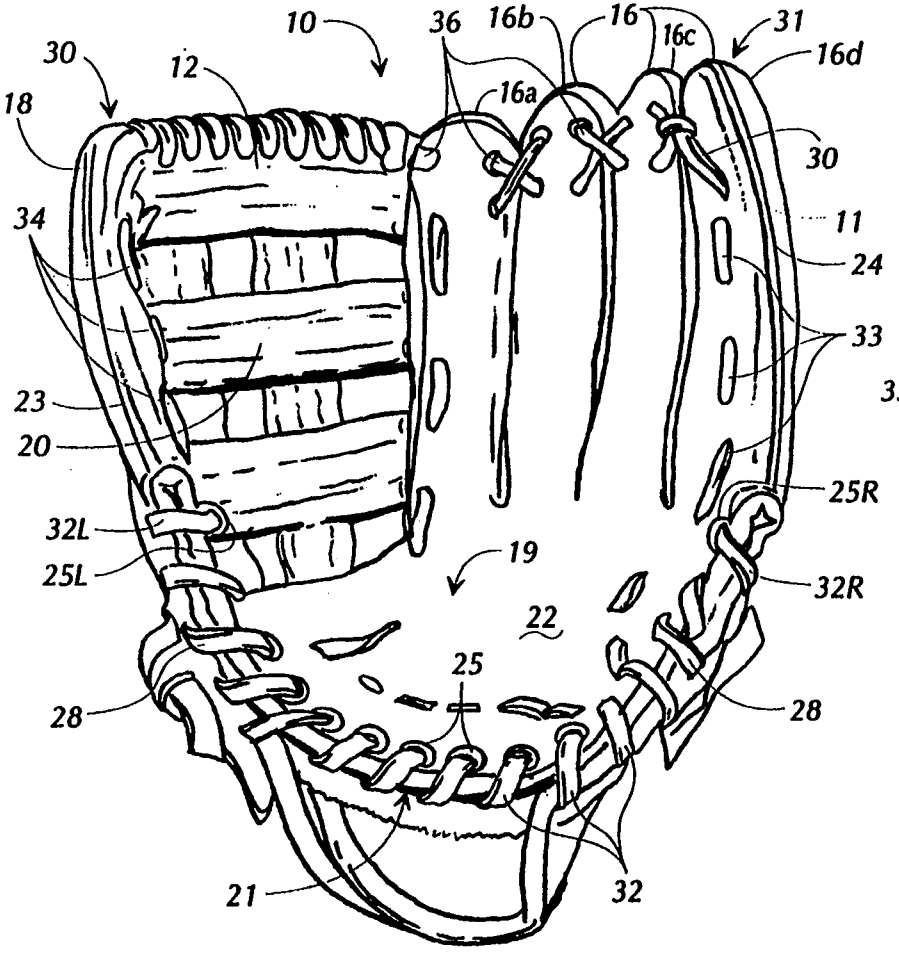
FIG. 1 is a pictorial view of the front or inner side of a glove embodying the present invention.

Referring now to the drawing, in which like reference numerals represent like elements throughout the several views, FIG. 1 discloses a glove 10 incorporating the features of the present invention. The glove depicted is intended to fit the left hand of a right-handed player. However, it will be understood that the systems described herein can be used in either a right-handed or a left-handed glove. In addition, while the glove 10 described herein is a fielder's glove, it will be appreciated that the present invention may easily be adapted to other types of gloves such as a catchers' mitt and a first baseman's mitt.

Figure 2:
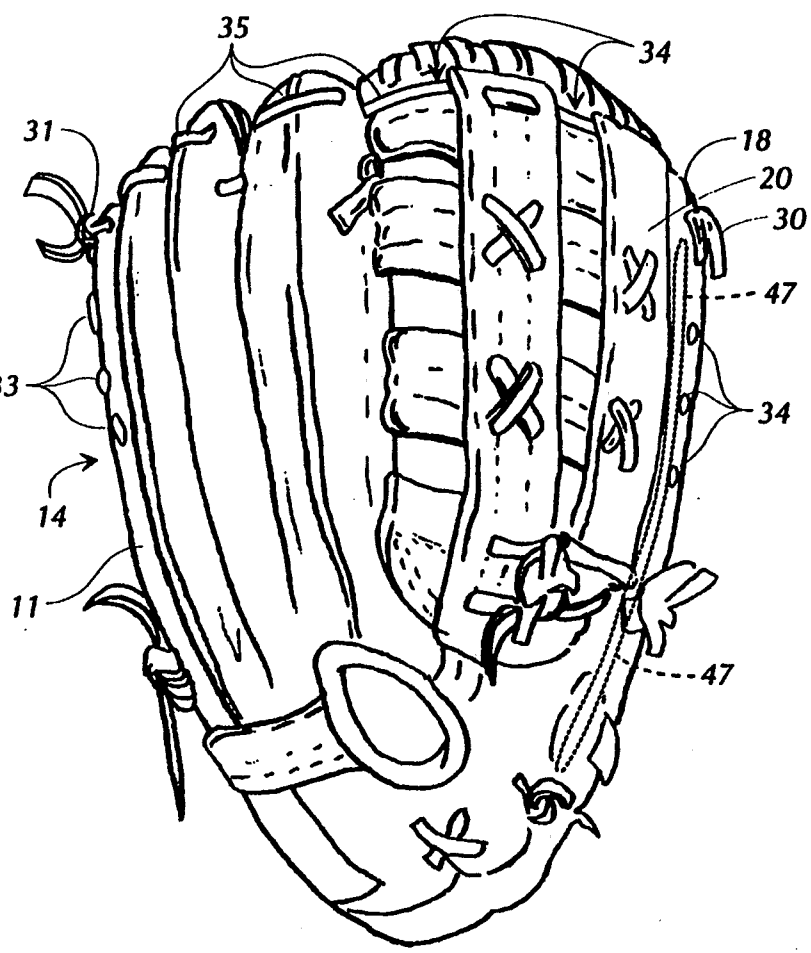
FIG. 2 is a pictorial view of the back side of the glove of FIG. 1.

The outer shell 11 of the glove 10 is preferably leather and is of a design such is known in the industry. As shown in FIGS. 1 and 2, the glove includes a front or inner side 12 and a back side 14. The glove shown in FIG. 1 includes four finger stalls 16, a thumb stall 18, and an open web 20. The finger stalls are designated 16*a–d*, with 16*a* being the stall corresponding to the index finger of a user, 16*b* corresponding to the middle finger, 16*c* corresponding to the ring finger, and 16*d* corresponding to the little finger. The glove includes a palm 19 which extends from the bottom of the finger stalls 16*a*, the webbing 20, and thumb stall 16, down to a heel 21. The palm 19 includes a pocket 22. The heel 21 extends around the bottom of the glove 10 from the lowermost end of the thumb stall 18 to the lowermost end of the little finger stall 16*d*. The outer edge of the thumb stall 18 defines a first lateral edge 23 of the glove 10, and the outer edge of the little finger stall 16*d* defines a second lateral edge 24 of the glove opposite the first lateral edge 23. A plurality of eyelets 25 are disposed along the lower margin of the heel 21 for receiving lacing, as will be hereinbelow described. Included among this plurality of eyelets 25 are a leftmost eyelet 25L and a rightmost eyelet 25R.

As is known in the art, the glove has two layers of leather: the outer shell 11 and an inner layer (not shown) disposed within the shell which, when in use, is juxtaposed against both sides of the hand of a user for comfort. The pocket 22 of the glove has extra padding (not shown) at the palm to prevent stinging when the ball is caught flat against the palm.

The glove 10 further comprises a lacing system comprising a first lace 28 which extends around the periphery of the glove from the upper end 30 of the thumb stall 18, down the length of the thumb stall, across the heel 21, and up the little finger stall 16*d* to its upper end 31. The lace 28 is stitched to the glove 10 beginning at the leftmost eyelet 25L which is furthest left on the heel 21 of the glove 10 as seen in FIG. 1. The lace 28 is inserted into the leftmost eyelet 25L from the front side 12 and through the eyelet to back side 14 of the glove 10. A sufficient length, approximately ten to twelve inches, of the lace 28 remains extended from the leftmost eyelet 25L at the back side 14 of the glove 10 so that the stitching may later be extended up the thumb stall 18. The lace 28 is then used to form a plurality of lacing loops 32 which are stitched through the eyelets 25 and along the heel 21 of the glove 10. This plurality of loops 32 includes a leftmost or first loop 32L and a rightmost or last loop 32R. Wrapping the lacing around the edges of the glove and through eyelets is known in the art. However, unlike gloves of the prior art which tie the lacing off at the rightmost loop 32R, the lacing of the present invention continues up the finger stall 16*d* corresponding to the little, or "pinky", finger, as is shown at 33.

The rightmost loop 32R is formed by extending the lace 28 out of the back side 14 of the glove 10 and wrapping the lace around the front side 12 of the glove. To orient the lacing 28 such that it will be extended out of the back side 14 instead of the front side 12, it may be necessary to reverse the wrapping of the loops 32 around the heel 21. This may be done by extending the lacing 28 through only one of the layers of the leather which are wrapped together at the heel 21 and then coming back up through the same layer through the next one of the eyelets 25. The wrapping may then return back to create loops at the eyelets 25 which have been skipped. Once these skipped eyelets are used, the lace 28 can be extended through the layers of leather to the adjacent eyelet 25. In this manner, the loops 30 are being wrapped in the correct direction once the final eyelet is reached where the last loop 32R is to be formed.

The lace 28 continues from the last loop 32R up the little finger stall 16*d* and is alternately stitched through the outer shell 11 and inner layer back to front, front to back, as shown at 34, until reaching the upper end 31 of the little finger stall 16*d*. A substantial length of the lacing 28 extends across the front side of the little finger stall 16*d*. The lace 28 extends through the front side 12 and back side 14 of the outer shell 11 of the glove so as to position any padding (not shown) for the glove. The end of the lace 28 then extends out of the upper end 31 of the finger stall 16*d*. It will be understood that the length of the lace 28 which is stitched along the length of the little finger stall 16*d* is anchored only at the upper end 31 of the finger stall and at the last loop 32R at the heel 21 of the glove. At locations therebetween the lace 28 is slidable with respect to the finger stall 16*d* such that a tension exerted along this length of the lace 28 will be translated from the heel of the glove to the upper end of the finger stall.

The free end of the lace 28 hanging from the leftmost eyelet 25L is now stitched to the thumb stall 18 as follows. From the leftmost loop 32L the lace 28 is wrapped around the edge of the glove 10 and stitched into the thumb stall 18. The end of the lace 28 is then stitched up the length of the thumb stall 18, in a manner similar to the stitching of the little finger stall 16*d*. Also, it is preferable that the stitching along the thumb stall 18 extend a majority of the length along the front side of thumb stall. As is the case with the length of lace stitched to the finger stall 16*d*, the length of the lace 28 stitched to the thumb stall 18 is anchored only at its upper and lower ends, and portions of the lace therebetween are freely slidable with respect to the thumb stall. In this manner a tension exerted at the upper end of this length of the lace 28 will cause the lace to slide with respect to the thumb stall and draw the upper end of the thumb start toward the heel of the glove, thereby causing the thumb stall to bow inwardly.

The lacing system of the glove 10 further comprises a second or upper lace 35 which begins at the upper end 31 of the little finger stall 16*d* and extends across the top of the glove. The second lace 35 forms X-shaped patterns 36 between adjacent finger stalls 16 for holding the finger stalls in place. The lace 35 extends from the X-shaped pattern 36 between the first and second finger stalls 16*a* and 16*b* to and across the back of the webbing 20, as is shown generally at 38 in FIG. 2. From the webbing 20, the lace 35 is stitched into the upper end 30 of the thumb stall 18 and extends out the back of the thumb stall 18.

In the preferred embodiment the rightmost end of the second lace 35 is tied to the corresponding end of the first lace 28 at the upper end 31 of the little finger stall 16*d*. Similarly, the leftmost end of the second lace 35 is tied to the corresponding end of the first lace 28 at the upper end 30 of the thumb start 18. In this manner the first and second laces form a continuous path around the periphery of the glove 10.

Figure 3:
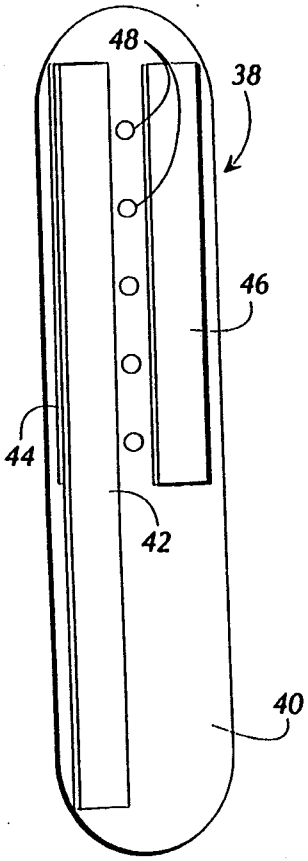
FIG. 3 is a pictorial view of an insert for use in the thumb stall of the glove of FIG. 1.

The glove 10 also incorporates a unique support system comprising a plurality of structural inserts such as the insert 38 in FIG. 3. The insert 38 includes a foam pad 40 and a plurality of elongated brace members affixed thereto. A first, relatively flexible brace 42 extends the length of the foam pad 40. An elongated second brace 44, preferably stiffer than the first brace 42, extends along the back side of the first brace 42, from the upper edge of the insert 38 to just below the middle of the first brace 42. An elongated third brace 46, of the same length and stiffness as the second brace 44, is positioned to the right of the braces 42 and 44, as is shown in FIG. 3, and is also aligned with the upper portion of the insert 38.

The insert 38 is positioned within the thumb stall 18 of the glove 10, between the outer shell 11 and the inner layer of leather which contacts the user's hand. Holes 48 are located in the insert through which the lace 28 is stitched to anchor the insert 38 in position within the thumb stall 18. Alternatively, the foam padding 40 may be of a material which is easily pierced such that the lacing may be stitched through the insert when assembling the glove. When properly located within the thumb stall 18, the upper end of the insert 38 extends to a location adjacent the upper end 30 of the thumb stall. The length of the braces 42, 44, and 46 is such that when the insert 38 is positioned within the thumb stall 18, with the upper end of the insert adjacent the upper end 30 of the thumb stall 18, the lower end of the brace 42 extends downward approximately to the ball of the wearer's thumb, and the lower ends of the braces 44 and 46 extend downward to a location intermediate the base of the thumb and the first joint of the thumb.

In the disclosed embodiment, the braces 42, 44, and 46 are formed from Owens-Corning S2-glass with a matrix material of an epoxy or a resin. The braces preferably comprise about 60–70 volume percent S2-glass in a polyphenylene sulfide (PPS) or a resin matrix, giving the braces a desirable flexural strength. The S2-glass gives high flexibility as well as an extended fatigue life. However, it will be understood that the braces may be comprised of any suitable material which exhibits suitable flexibility, resilience, elasticity, and toughness to give a useful flexural fatigue life. Examples of suitable materials are spring steel, advanced composite thermoplastics, thermosels, engineered plastics, and fiber reinforced plastics. Furthermore, since the brace 42 is preferably more flexible than the braces 44 and 46, it may be desirable to construct the brace 42 from a lighter and more flexible material than is used for the braces 44 and 46, such as nylon in a polyaramid matrix. The polyaramid would preferably be Kevlar®, as made by the DuPont Corporation, and the nylon would preferably be nylon 12, so as to prevent moisture permeation. The braces may be compression molded, stamped, or pultruded. In addition, an antimicrobial such as Microban® by Clinitex of Huntersville, N.C. may be added to the resin system to destroy or inhibit the growth of microorganisms.

The pad 40 and braces 42, 44, and 46 may be formed as one piece by stamping, pultrusion, or other suitable manufacturing method. Alternatively, the pad 40 and braces 42, 44, and 46 may be formed as separate components and fastened together by glueing, mechanical fasteners, or other suitable arrangement. The pad 38 is preferably comprised of a closed cell foam to prevent mold and mildew.

The braces of the present system urge the glove into an opened formation, help to maintain the shape of the glove, and give control to the user. The braces preferably extend up the thumb and at least one of the fingers.

Figure 4:
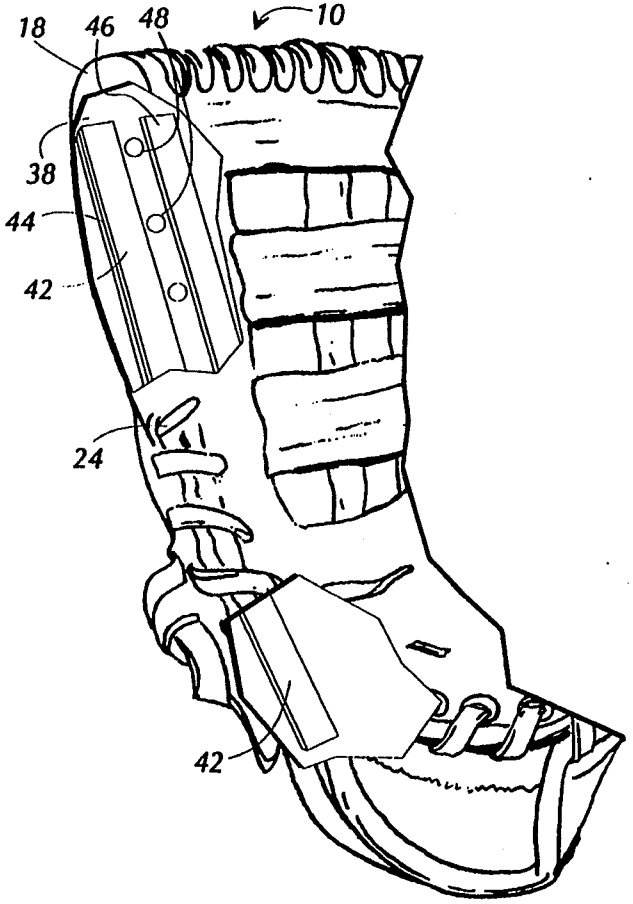
FIG. 4 is a cutaway perspective view of the insert of FIG. 3 installed in the glove of FIG. 1.

The brace 42 is used to maintain the opened position of the glove 10. As best shown in FIG. 4, when the insert 38 is in the glove 10, the brace 42 extends down to the palm 19 of the glove. The thumb stall 18 is supported and forced outward by the resistance of the brace 42 to bending. The natural curve of the wearer's hand causes this brace 42 to bend into a curved formation when the glove is worn. Insertion of the user's hand into the glove forces the lower end of the brace 42 against the flat, palmar region of the user's thumb, urging the lower end of the brace 42 forward. Because the brace has a memory for a straight orientation, it attempts to align the upper portion of the brace 42 with this bent lower portion, causing the thumb stall to be forced outward and urging the glove 10 into an open position.

Additional support is added to the thumb stall by the upper braces 44 and 46. These upper braces 44 and 46 preferably have a greater resistance to bending, such as the S2-glass composites described above, than the brace 42. The upper braces 44 and 46 support the upper end 30 of the thumb stall 18 and serve as a leverage system for the thumb. In addition, the upper braces 44 and 46 help push the upper portion 30 of the thumb stall 18 outward and force pressure outward on the upper comers of the thumb stall. The brace 44 extends across the back of the weaker brace 42 to add greater stiffness at the top region of the thumb stall 18.

Use of the flexible brace 42 and the rigid braces 44 and 46 prevents the thumb from any substantial bending motion at its upper joint. However, because the flexible brace 42 is capable of bending, the thumb can move inward as a whole, allowing a pinching mechanism to be created between the thumb and the fingers of the hand. The stiffer braces 44 and 46 maintain the integrity of the upper portion of the thumb stall 18, preventing its bending.

Because of the unique nature of the braces 42, 44, and 46, they maintain their form over the life of the brace, always forcing the glove into the proper position even after the leather is fully broken in. To further reinforce the thumb stall 18, another brace, shown in phantom at 47 in FIG. 2, can be extended across the back of the thumb stall 18. This brace 47 is preferably of the same composition as the braces 44 and 46 and adds even more unity of movement of the thumb of a user and the thumb stall 18. The natural movement of the hand when performing the pinch mechanism causes the uppermost extremity of the thumb to apply the majority of pressure to the thumb stall. This uneven pressure causes a "break" in the leather of the thumb stall 18 at the uppermost tip of the thumb of a user. In response, the thumb stall "rolls" backward, not allowing the uppermost part of the thumb stall to move responsive to the movement of the thumb. The pressure of the additional brace 47 at the back of the thumb stall provides additional leverage to the thumb and helps to distribute the pressure applied by the thumb when performing the pinch mechanism. In this manner, the break and roll may be prevented, and the thumb and thumb stall 18 may move together as a single unit.

As can be determined from the above, movement of the thumb stall 18 and the portion of the glove near the stall are directly linked to the movement of the thumb. The longer, more flexible brace 42 extends down the thumb stall 18 to the palm 19. The flat, palmar region of the hand in the glove tends to cause the brace 42 to force the thumb stall 18 outward, holding the glove in an open position. However, because the flexible brace 42 is contained within a glove made of substantially inextensible material, the resistance of this more flexible brace to bending may not be sufficient to overcome the inextensibility of the material and to hold the top end of the thumb stall outward. Therefore, the stiffer, more rigid braces 44 and 46 are included in the thumb stall to help push the upper portions of the thumb stall 18 outward and to force pressure outward on the upper corners of the thumb stall. This outward pressure maintains the glove in an open position so that the glove is easily handled by a younger player or a player with weaker hands. Holding the glove in an opened position adds an extra benefit of safety to the present invention. Players that have difficulty in opening a conventional glove stand a chance of being hit by a ball. Biasing a glove to the opened position as is provided by the present invention overcomes this problem. Finally, the brace 47 extending across the back of the thumb stall 18 prevents bending and rolling of the thumb stall during use of the glove 10. This allows easy maneuvering of the thumb stall 18 inward relative to the palm 19, making closing of the glove possible by the pinch mechanism of the hand.

Figure 10:
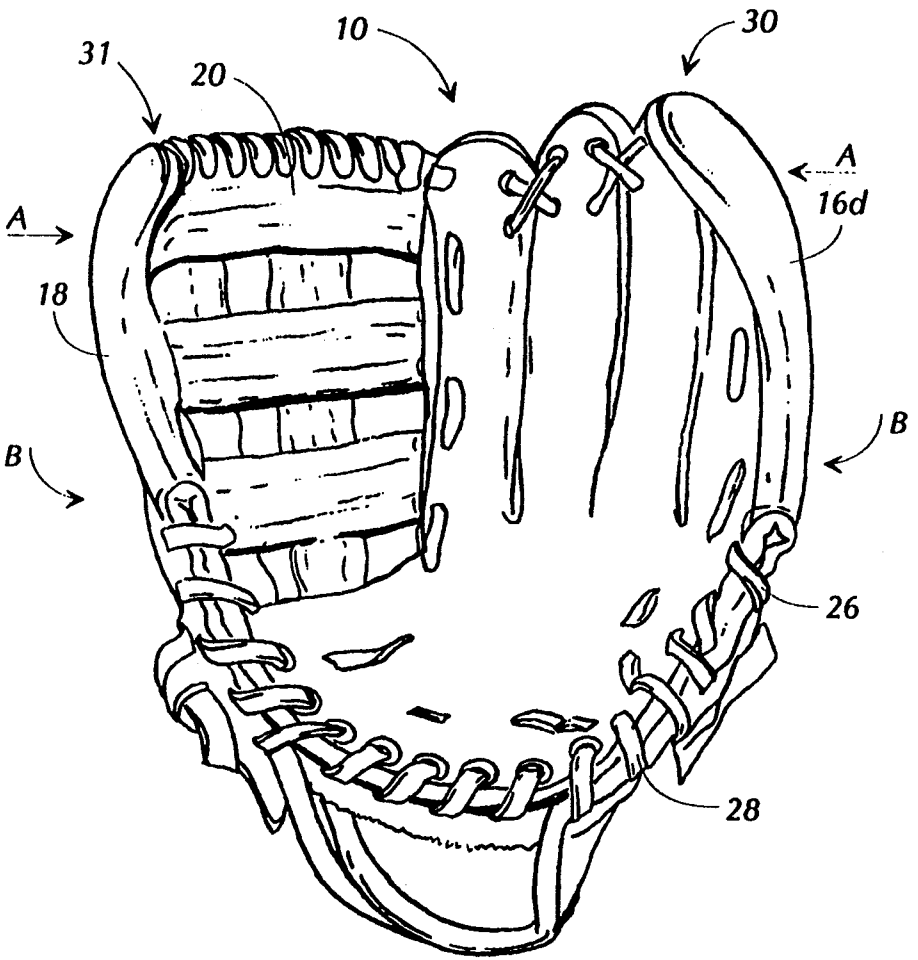
FIG. 10 is a pictorial view of a baseball glove with a U-shaped pocket as provided by the present invention.

Another embodiment of a thumb insert 138 is shown in FIG. 10. The insert 138 of FIG. 10 includes two foam pads 140 and 240. The first pad 140 is designed to fit into the palm 19 of the glove 10 and the second pad 240 is designed to be fitted into the thumb stall 18 of the glove. A brace 142, similar in composition to the earlier described brace 42, extends between and through each of the pads 140 and 240. The brace 142 serves the same function as the previously described brace 42. Similarly, a second brace 146 is located within the pad 240 and serves a function similar to the braces 44 and 46, described above. An advantage of this system is that the upper end of the brace 142 may be slidingly received in the upper pad 240. Thus, the brace 142 may move in and out of the pad 240 responsive to movement of the thumb stall inward and outward. This movement may prevent any potential breaking, buckling, or binding of the brace 142. In addition, the brace may be easily replaced by replacing the pad 140 and the brace 142, without need to remove or replace the pad 240.

Figure 5:
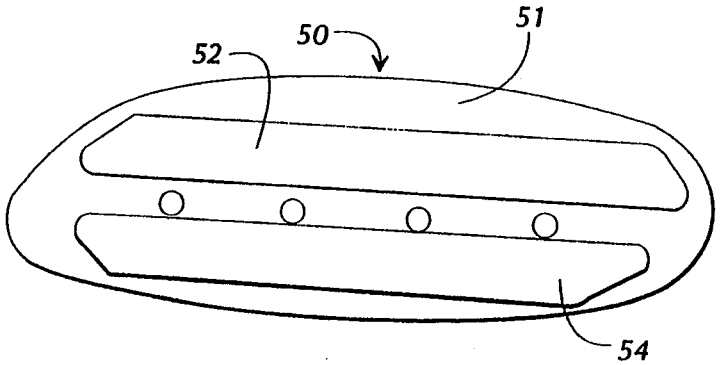
FIG. 5 is a pictorial view of an insert for use in the little finger stall of the glove of FIG. 1.

Similar to the thumb insert 38, an insert 50, as is shown in FIG. 5, is designed to be received in any or all of the finger stalls 16. The finger insert 50, like the thumb insert 38, is preferably replaceable so that if the useful life of the glove extends that of the insert, the insert may be replaced. The insert 50 is similar in design to the thumb insert 38, and includes foam padding 51, but preferably includes only two braces 52 and 54. The insert 50 is placed between the outer shell 11 of the glove 10 and the layer of leather which contacts the hand on the front side 12 of the glove 10. The braces 52 and 54 are situated to extend, when the glove is in use, from the juncture of the finger and the palm of the hand of the user to the end of the finger start 20. In this manner, the braces 52 and 54 serve to maintain the integrity of the upper portion of the respective stall and cause the stall to move in conjunction with the respective finger. Therefore, the braces 52 and 54 act as extensions and levers for the finger of the respective stall.

It is to be understood that any number or type of braces can be used for any of the finger stalls 16 or the thumb stall 18, and the invention could work with many different arrangements of individual or multiple braces. For example, round braces could be used instead of the flat braces. The braces could extend down the back of the hand or could be stitched into the welting of the glove. The invention could use one brace which extends along the lateral edge 23 of the thumb stall 18 from the upper end 30 of the thumb stall 18, around the heel 21, and up the lateral edge 24 of the finger stall **16*d* to the upper end 31 of the stall 16*d*. The braces 42 and 44 of the invention could be stamped out essentially as a one-piece brace which tapers from an upper end to a lower end. The upper end of such a one-piece brace would be thicker, and hence stiffer, at its upper end and taper to a thinner, and hence more flexible, configuration at its lower end. This one-piece brace could be stamped with or within a foam-like structure. Similarly, the laces 28 and 35 could be a synthetic material, Kevlar, nylon, or a composite that has resilience. Also, to further urge the glove into an open position, a round or flat brace could extend from the thumb stall 18 around the back side 14 of the webbing 20 to the finger stalls 16**. This brace could be within the lacing system or journaled within the glove.

The support system of the present invention gives form to a glove without need for the thick pads or inflexible material of prior art gloves. The removal of the major thick pads of prior art gloves and the addition of the braces allows for a number of advantages. The gloves are lighter because they do not need heavy leather or padding for support. Use of the lighter weight material without the heavy, stiff pads permits the gloves to be "broken in" when bought. This is very important because some conventional gloves take weeks of breaking in before becoming useful. Furthermore, the lack of the heavy padding system in the glove and the use of braces in the glove allows for two hinging points, causing the glove to close in more of a pocket formation.

Figure 8:
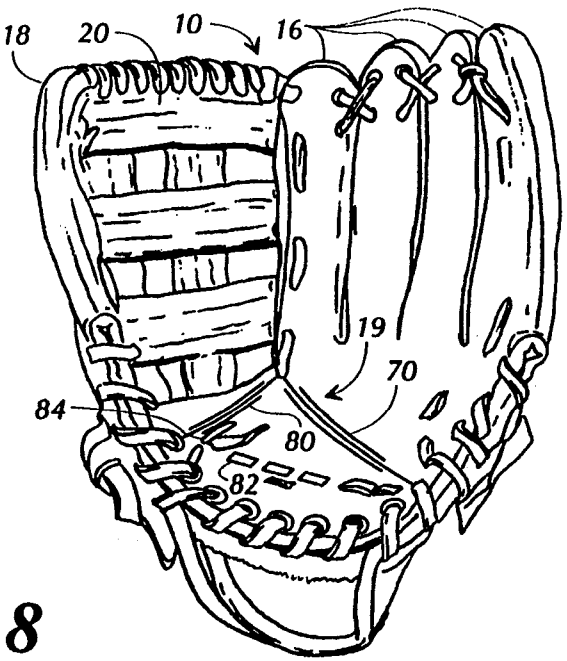
FIG. 8 is a pictorial view exhibiting the hinging system of the present invention.
Figure 7:
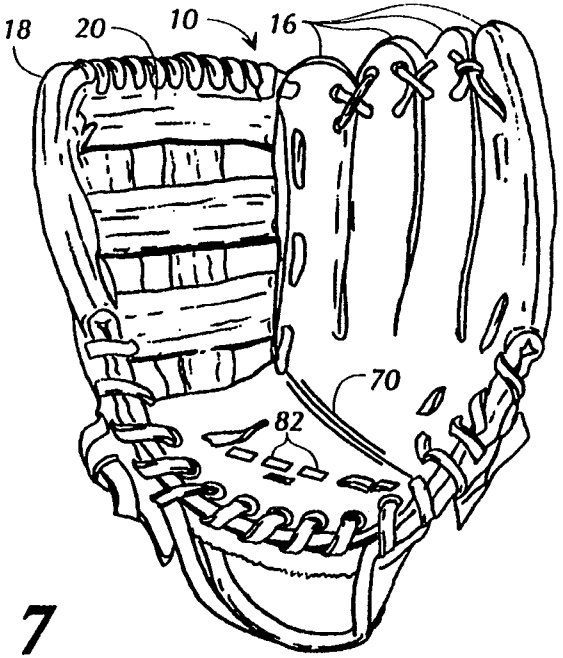
FIG 7 (PRIOR ART)
FIG. 7 is a pictorial view of a glove exhibiting the prior art hinges for closing gloves.
Figure 6:
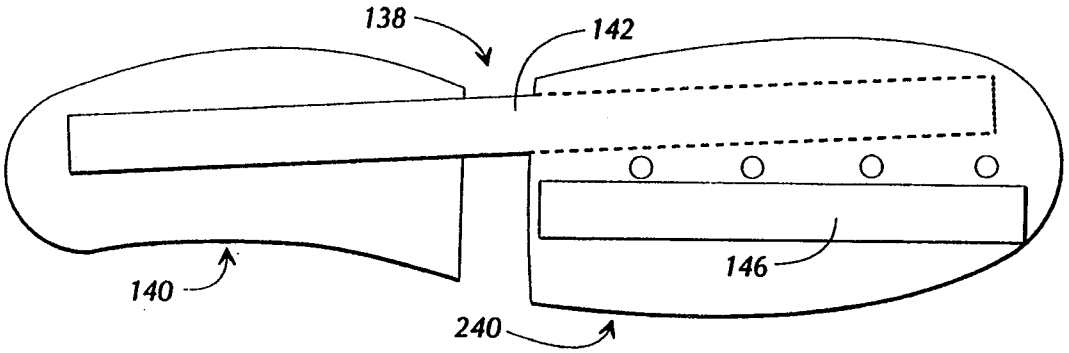
FIG. 6 is a pictorial view of an alternative embodiment of the insert of FIG. 3.

The difference between hinge systems in the prior art and the present glove are depicted in FIGS. 7 and 8. As in prior art gloves such as is depicted in FIG. 7, a hinge line 70 is formed and the fingers may be moved inward along the MP joint in the glove embodying the present invention, such as is shown in FIG. 8. If the glove could only be closed along this hinge line, such as in conventional gloves, then closing the glove would require a movement of the finger stalls 16 toward the thumb stall 18 and the webbing 20. Thus, the finger stalls 16 overlay the webbing 20, creating a wedge for closing a ball within. However, unlike conventional gloves, the use of the braces in the present glove 10 allows for movement of the thumb stall 18 inward, creating a second hinge line 80. This second hinge line 80 runs from approximately the leftmost corner of the heel at the base of the thumb stall 18 upward into the pocket. To accomodate this second hinge line 80, stitching 82 in the palm 19 of the glove does not extend all the way to the thumb stall, as in a conventional glove, but instead turns and extends downward toward the base of the glove, as shown by the reference numeral 84 in FIG. 8.

This allows for easy closing and quick release of the glove by allowing the pinching mechanism of the thumb and the fingers to be used. The simultaneous movement of the thumb stall 18 and the finger stall 16 inward allows the stalls to meet at the middle, and, more importantly, maintains the pocket shape of the glove until closing occurs. This more circular, pocket shape is more conducive to catching than the wedge-shaped pocket of prior art gloves. In addition, closing the glove using the pinch mechanism exercises and therefore increases the strength of the pinch mechanism of the hand, which gives the user more control of the glove.

Figure 9:
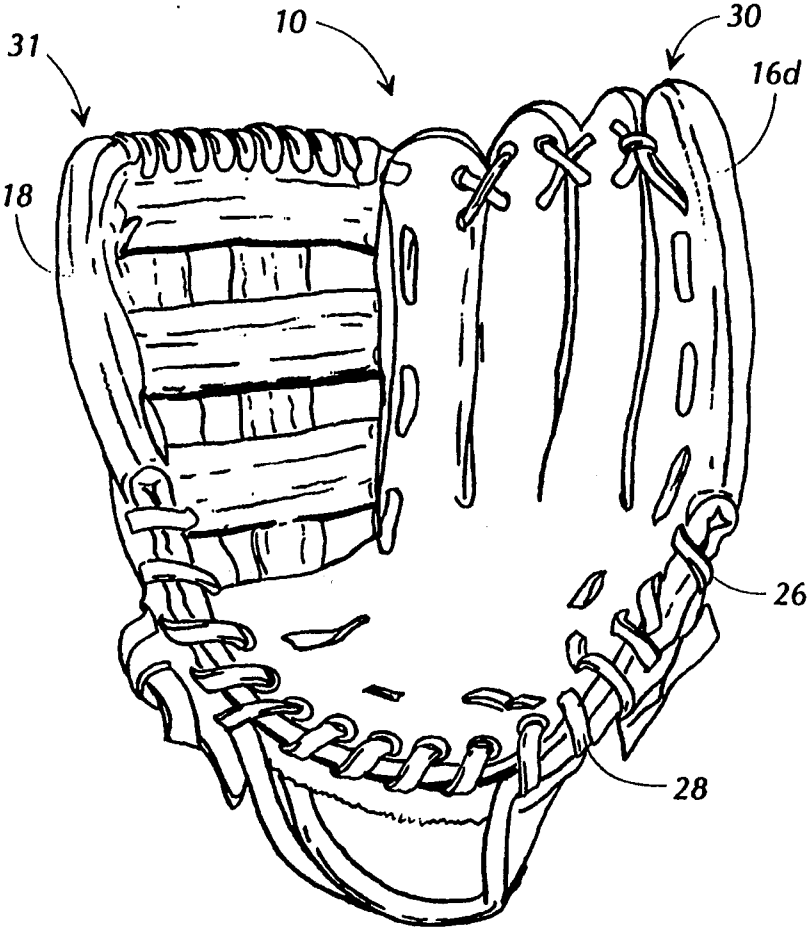
FIG. 9 is a pictorial view of a glove with a conventional pocket.

Although it is ideal for a glove to remain in the open position when on the hand of a user, some players, especially infield players, prefer that more of a "U-shape pocket" be formed by the glove, so as to better trap the ball upon catching or fielding. The difference between a glove with a U-shape pocket and without can be spotted in FIGS. 9 and 10. FIG. 9 depicts a glove with a conventional pocket and FIG. 10 shows a glove with a U-shape pocket. The U-shape pocket is developed by pushing outward the thumb and finger stalls, yet drawing inward the upper tips of those stalls. Thus, the pocket forms a U-shape with the upper ends of the U being curved inward, such as is shown by the arrows in FIG. 10. This pocket is provided in the present invention by the support system and the continuous lacing system.

As discussed above, the braces in the present system force the stalls outward and the glove into an open position. The lacing system, however, may be untied at the thumb at 31 or at the little finger at 30, pulled tight and retied so as to shorten the loop around the perimeter of the glove. Shortening the loop across the top of the glove at the X-shaped pattern 32 and across the back of the webbing 20 naturally pulls the upper tips of the stalls inward, as is shown by the A arrows in FIG. 10. The tension created across the loops 24 and 26 causes the thumb and little finger stalls to roll so they face each other, as is shown at the regions near the B arrows in FIG. 10. Finally, stitching the lacing 28 along the length of the thumb and little finger stalls 18, **16*d* so that the majority of the lacing extends along the inner surfaces of these stalls locates the majority of the tensioning in the laces across the front side of the stalls. Adjusting the tension in the portions of the lacing 28** which extend along the thumb and finger stalls also affords control over the extent to which the upper tips of the stalls are drawn inward and causes the fingers to bend into the ideal concave shape. Other systems may be used to pull the system tight and to hold the strings in place, such as drawstrings (not pictured). The pushing outward on the thumb and finger stalls by the brace system and pulling inward of the upper tips of those stalls by the continuous lacing system forms a U-shape pocket. By adjusting the lacing system, a user may form his or her glove into a desired pocket configuration.

The glove 10 has been disclosed with respect to a lacing arrangement comprising two laces 28 and 35 the ends of which are tied to one another to form a continuous lacing system around the periphery of the glove. These knots are located at the back of the glove so as to not impede catching. Alternatively, the system may use a single long lace which extends around the entire perimeter of the glove 10 and is tied to itself at the upper end 31 of the little finger stall **16*d***.

It will further be appreciated that the ability to control the contour of the thumb stall and finger start does not require the portion of the lacing which runs along the heel of the glove. Rather, the contour of the thumb and finger stalls is achieved by a lacing arrangement wherein the lace runs the length of the thumb stall or finger stall, is anchored only at the upper and lower ends of the thumb or finger start, and permits control over the length of the lacing so as to cause the stalls to "bow" by tightening the lacing. While the loops of lacing along the heel of the glove provide the preferred method of anchoring the lower ends of the laces which run the length of the thumb and finger stalls, it will be appreciated that other arrangements for anchoring the lower ends of these laces may be used, and that it is not crucial that the thumb and finger stalls be stitched with the same lacing.

While the glove 10 has been disclosed with respect to an embodiment comprising both a novel bracing arrangement and a continuous lacing system working in concert, it will be appreciated that benefits can be obtained by employing either the bracing system with a conventional lacing arrangement, or by employing the continuous lacing system without the novel bracing arrangement.

It can be seen that the glove of the present invention offers many benefits over prior art gloves. The glove is lightweight, broken-in when new, and easier to open and close than conventional gloves. The brace system and continuous lacing system of the present system allow an ideal pocket configuration to be formed for any player.

While this invention has been described in detail with particular reference to preferred embodiments thereof, it will be understood that variations and modifications can be affected within the spirit and scope of the invention as described herein and before and as described in the appended claims.

What is claimed is:

1. A baseball glove defining a front side and a back side thereon, said baseball glove comprising:

a thumb stall an outer edge of which defines a first lateral edge of said glove, said thumb stall having an upper end and a lower end;

a finger stall an outer edge of which defines an opposing second lateral edge of said glove, said finger stall having an upper end and a lower end;

a heel portion interconnecting said lower end of said thumb stall and said lower end of said finger stall;

a palm located adjacent to said heel portion, an inside portion of said palm configured to engage the palm of a user when the user's hand is in the glove: and a first flexible, resilient brace defining an initial shape and having a resistance to bending and a tendency to fully recover to said initial shape after bending, said brace extending along said first lateral edge and at least a portion of the palm of the glove from a point which is adjacent said heel to a first location up said thumb stall, such that said resistance of said brace to bending causes said thumb stall to be biased away from said little finger stall, urging said glove into an open position.

2. The baseball glove of claim 1, wherein said first and second laces comprise a continuous lace extending along a path from approximately said upper end of said thumb stall, down the length of said thumb stall to said heel portion, along said heel portion to said lower end of said finger stall, and up the length of said finger stall to approximately said upper end of said finger stall, said lace being anchored to said glove at said upper end of said thumb stall, along said heel portion, and at said upper end of said finger stall.

3. The baseball glove of claim 1, wherein said glove further comprises an upper periphery, and further comprising a lace extending along a path from said upper end of said finger stall along said upper periphery to said upper end of said thumb stall.

4. The baseball glove of claim 3, wherein said lace which extends across said path from said upper end of said finger stall along said upper periphery to said upper end of said thumb stall comprises a continuation of said lace which extends along said path from approximately said upper end of said thumb stall, down the length of said thumb stall to said heel portion, along said heel portion to said lower end of said finger stall, and up the length of said finger stall to approximately said upper end of said finger stall.

5. The baseball glove of claim 4, wherein said lace comprises first and second ends, and wherein said first end of said lace is tied to said second end of said lace.

6. The glove of claim 3, wherein said lace which extends across said path from said upper end of said finger stall along said upper periphery to said upper end of said thumb stall comprises a second lace.

7. The baseball glove of claim 6, wherein said first and second laces each comprise first and second ends, and wherein said first end of said second lace is tied to said first end of said first lace, and said second end of said second lace is tied to said second end of said first lace.

8. The baseball glove of claim 1, wherein said brace is a brace comprising a polyaramid and nylon.

9. The baseball glove of claim 1, further comprising at least one additional flexible, resilient brace defining a second initial shape and having a tendency to fully recover to said second initial shape after bending, said tendency creating a resistance in said additional brace to bending, said additional brace extending from a region in said glove which is adjacent to the joint of the thumb and the palm of the user when the user's hand is installed in said glove to a second location up said thumb stall, said resistance of said additional brace to bending giving support to said thumb stall and urging said second location on said thumb stall away from said little finger stall.

10. The baseball glove of claim 9, wherein said additional brace comprises S2-glass in a matrix comprising one of the substances that are in the set of PPS and epoxy and resin.

11. The baseball glove of claim 9, further comprising an insert, said first brace and said additional brace being mounted on said insert.

12. The baseball glove of claim 10, wherein said additional brace is shorter than said first brace, and said additional brace is aligned to correspond to the upper portion of said first brace.

13. The baseball glove of claim 1, wherein said first brace defines upper and lower ends thereon and said first brace is substantially rigid at said upper end and more flexible at said lower end.

14. The baseball glove of claim 13, further comprising a second brace operatively associated with said upper end of said first brace, wherein said second brace serves to stiffen said upper portion of said first brace.

15. The baseball glove of claim 13, wherein said first brace tapers in width from said upper end to said lower end so as to provide more rigidity at said upper end than said lower end.

16. The baseball glove of claim 9, further comprising at least one other flexible, resilient brace defining a third initial shape and having a tendency to fully recover to said third initial shape after bending, said other brace extending along one of said finger stalls from a region in said glove which would be adjacent to the joint of the corresponding finger and the palm of said user when said user's hand is installed in said glove to a location up said one of said finger stalls, said resistance of said other brace to bending giving support to said one of said finger stalls and urging said location on said one of said finger stalls away from said thumb start.

17. The baseball glove of claim 16, wherein said other rod comprises S2-glass in a matrix comprising one of the substances in the set of PPS and epoxy and resin.

18. The baseball glove of claim 16, further comprising at least another flexible, resilient brace defining a fourth initial shape and having a tendency to fully recover to said fourth initial shape after bending, said tendency creating a resistance in said another brace to bending, such that when said glove is installed on the hand of a user, said another brace extends along said back side of said thumb stall from a region adjacent the joint of the thumb and the wrist of said user to a third location adjacent the end of said thumb stall;

whereby said resistance of said another brace to bending causes the movement of said thumb to be leveraged so as to cause said thumb stall to move in accordance to movement of said thumb.

19. The baseball glove of claim 18, wherein said another rod comprises S2-glass in a matrix comprising one of the substances that are in the set of PPS and epoxy and resin.

20. The baseball glove of claim 18, further comprising:

a first lace extending from approximately said upper end of said thumb stall, down the length of said thumb stall to a first location adjacent said heel portion, said first lace being anchored at said upper end of said thumb stall and at said first location adjacent said heel portion and extending from the back side to the front side and back to the back side through a series of holes, said lace being freely slidable through said holes; and a second lace extending from approximately said upper end of said finger stall, down the length of said finger stall to a second location adjacent said heel portion, said second lace being anchored at said upper end of said finger stall and at said second location adjacent said heel portion and extending from the back side to the front side and back to the back side through a series of holes, said lace being freely slidable through said second series of holes;

whereby the contour of said thumb stall and said finger stall can be controlled by adjusting the tension in said first and second laces.

21. The baseball glove of claim 1, further comprising at least another flexible, resilient brace defining a fourth initial shape and having a tendency to fully recover to said fourth initial shape after bending, said tendency creating a resistance in said another brace to bending, such that when said glove is installed on the hand of a user, said another brace extends along said back side of said thumb stall from a region adjacent the joint of the thumb and the wrist of said user to a third location adjacent the end of said thumb stall;

whereby said resistance of said another brace to bending causes the movement of said thumb to be leveraged so as to cause said thumb stall to move in accordance to movement of said thumb.

22. The baseball glove of claim 21, wherein said another brace comprises S2-glass in a matrix comprising one of the substances that are in the set of PPS and epoxy and resin.

23. The baseball glove of claim 1, further comprising:

a first lace extending from approximately said upper end of said thumb stall, down the length of said thumb stall to a first location adjacent said heel portion, said first lace being anchored at said upper end of said thumb stall and at said first location adjacent said heel portion and extending from the back side to the front side and back to the back side through a series of holes, said lace being freely slidable through said holes; and a second lace extending from approximately said upper end of said finger stall, down the length of said finger stall to a second location adjacent said heel portion, said second lace being anchored at said upper end of said finger stall and at said second location adjacent said heel portion and extending from the back side to the front side and back to the back side through a series of holes, said lace being freely slidable through said second series of holes;

whereby the contour of said thumb stall and said finger stall can be controlled by adjusting the tension in said first and second laces.

24. The baseball glove of claim 1, further comprising at least one other flexible, resilient brace defining a third initial shape and having a tendency to fully recover to said third initial shape after bending, said other brace extending along one of said finger stalls from a region in said glove which would be adjacent to the joint of the corresponding finger and the palm of said user when said user's hand is installed in said glove to a location up said one of said finger stalls, said resistance of said other brace to bending giving support to said one of said finger stalls and urging said location on said one of said finger stalls away from said thumb stall.

25. A baseball glove comprising:

a thumb stall defining a first lateral edge of said glove, said thumb stall having an upper end and a lower end;

a finger stall defining an opposing second lateral edge of said glove, said finger stall having an upper end and a lower end;

a heel portion interconnecting said lower end of said thumb stall and said lower end of said finger stall; and a flexible, resilient brace defining an initial shape and having a tendency to fully recover to said initial shape after bending, said brace extending along one of said finger stalls along the front side of said finger stall from a region in said glove which would be adjacent to the joint of the corresponding finger and the palm of a user when said user's hand is installed in said glove to a location up said one of said finger stalls, said resistance of said brace to bending giving support to said one of said finger stalls and urging said location on said one of said finger stalls away from said thumb stall.

26. An insert for a baseball glove comprising:

a thumb stall defining a first lateral edge of said glove, said thumb stall having an upper end and a lower end;

a finger stall defining an opposing second lateral edge of said glove, said finger stall having an upper end and a lower end;

a heel portion interconnecting said lower end of said thumb stall and said lower end of said finger stall;

a palm located adjacent to said heel portion, an inside portion of said palm configured to engage the palm of a user when the user's hand is in the glove; said insert comprising:

a first flexible, resilient brace defining an initial shape and having a tendency to fully recover to said initial shape after bending, said tendency creating a resistance in said brace to bending, said brace extending along said first lateral edge and at least a portion of the palm of the glove from a point which is adjacent said heel to a first location up said thumb stall, such that said resistance of said brace to bending causes said thumb stall to be biased away from said little finger stall, urging said glove into an open position.

27. The insert of claim 26, wherein said first brace defines upper and lower ends thereon and said first brace is substantially rigid at said upper end and more flexible at said lower end.

28. The insert of claim 27, further comprising a second brace operatively associated with said upper end of said first brace, wherein said second brace serves to stiffen said upper portion of said first brace.

29. The insert of claim 27, wherein said first brace tapers in width from said upper end to said lower end so as to provide more rigidity at the upper end than the lower end.

* * * * *